US006152008A

United States Patent [19]

Marshall

[11] Patent Number: 6,152,008

[45] Date of Patent: Nov. 28, 2000

[54] ROTARY CUTTING MECHANISM

[76] Inventor: Craig A. Marshall, 9470 County Hwy., C.H. 134, Nevada, Ohio 44849

[21] Appl. No.: 09/300,157

[22] Filed: Apr. 27, 1999

Related U.S. Application Data

[60] Provisional application No. 60/083,416, Apr. 29, 1998.

[51] Int. Cl.[7] ..... B26D 1/14

[52] U.S. Cl. ..... 83/671; 83/669

[58] Field of Search ..... 83/671, 678, 946, 83/675, 670, 465, 669, 691, 917, 676; 144/24.16, 230, 227

[56] References Cited

U.S. PATENT DOCUMENTS

| | | | |
|---|---|---|---|
| 3,695,109 | 10/1972 | Uhlig | 83/40 |
| 3,735,907 | 5/1973 | Kuchar et al. | 83/465 |
| 3,812,752 | 5/1974 | Jaegers | 83/675 |
| 3,812,753 | 5/1974 | Kiejzik | 83/917 |
| 4,115,000 | 9/1978 | Mischo et al. | 83/917 |
| 4,125,044 | 11/1978 | Carrigan et al. | 83/671 |
| 4,262,570 | 4/1981 | Doyle | 83/397 |
| 4,573,956 | 3/1986 | Johnson | 83/671 |
| 5,088,368 | 2/1992 | Marion | 83/671 |
| 5,181,665 | 1/1993 | Flisram | 83/675 |
| 5,216,961 | 6/1993 | Gray | 83/128 |
| 5,351,589 | 10/1994 | Creaden | 83/678 |

FOREIGN PATENT DOCUMENTS

| | | | |
|---|---|---|---|
| 579078 | 7/1924 | France | 83/917 |
| 403090229 | 3/1991 | Japan | 83/669 |
| 403090228 | 4/1991 | Japan | 83/669 |
| 406079697 | 3/1994 | Japan | 83/669 |

*Primary Examiner*—Rinaldi I. Rada
*Assistant Examiner*—Omar Flores-Sánchez
*Attorney, Agent, or Firm*—MacMillan, Sobanski & Todd, LLC

[57] ABSTRACT

A rotary cutting mechanism includes a holder and a fixture that cooperate to hold an article therebetween. A cavity is formed in the body of the fixture. A blade is rotatably mounted in the fixture cavity. The blade rotates between a first position in which the cutting edge of the blade is not operative to cut the article, and a second position in which the cutting edge is operative to cut the opening in the article. In another embodiment, the rotary cutting mechanism includes a fixture having a cavity formed in the fixture body, and a holding mechanism that holds the article on the fixture. A blade is rotatably mounted in the fixture cavity to cut the opening in the article.

16 Claims, 7 Drawing Sheets

ROTARY CUTTING MECHANISM

CROSS-REFERENCE TO RELATED APPLICATION

This application claims the benefit of U.S. Provisional Application Ser. No. 60/083,416, filed Apr. 29, 1998.

BACKGROUND OF THE INVENTION

This invention relates in general to cutting equipment, and in particular to a rotary cutting mechanism for cutting an opening in an article. In a preferred embodiment, the invention relates to a rotary cutting mechanism for cutting an opening in an edge or corner of a container.

Many different methods are known for forming shaped articles such as containers. One common method is thermoforming, in which a plastic sheet is heated, placed into a mold, and subjected to vacuum and/or pressure so that it conforms to the shape of the mold.

Articles such as thermoformed containers are often provided with openings for purposes such as air circulation, liquid drainage or heat venting. The openings are sometimes formed in an edge or corner of the container. In most containers, the edges/corners are formed by the sides of the container meeting at a generally perpendicular angle. However, other containers include nonperpendicular edges/corners. It is difficult to form openings in nonperpendicular edges/comers of containers.

SUMMARY OF THE INVENTION

The present invention provides a rotary cutting mechanism that is adapted for cutting openings in articles such as containers, including openings in nonperpendicular edges/corners of the containers. The rotary cutting mechanism includes a fixture and a holder that cooperate to hold the article therebetween. A cavity is formed in the body of the fixture. A blade is rotatably mounted in the fixture cavity. The blade rotates between a first position in which the cutting edge of the blade does not cut the article, and a second position in which the cutting edge cuts the opening in the article.

In another embodiment, the rotary cutting mechanism includes a fixture having a cavity formed in the fixture body, and a holding mechanism that holds the article on the fixture. A blade is rotatably mounted in the fixture cavity. The blade rotates between a first position in which the cutting edge of the blade does not cut the article, and a second position in which the cutting edge cuts the opening in the article.

DETAILED DESCRIPTION OF THE PREFERRED EMBODIMENT

Preliminarily, it should be noted that certain terms used herein, such as "upward", "downward", "upper" , "lower", "top", "bottom", "side", "clockwise", and "counterclockwise", are used to facilitate the description of the preferred embodiment of the invention and are not intended as a limitation on the orientation of the rotary cutting mechanism and its parts. It is contemplated that the rotary cutting mechanism may be mounted for cutting in any direction, such as horizontally or vertically.

The term "opening" will be used herein to refer to an opening of any shape and size, including a hole, a slot, a slit, and any other type of opening.

The term "article" refers to any type of article in which an opening can be cut, including shaped and unshaped articles, and articles formed from various materials is such as plastic, paper, wood or metal. A preferred article is a container such as a thermoformed plastic container.

Figure 1:
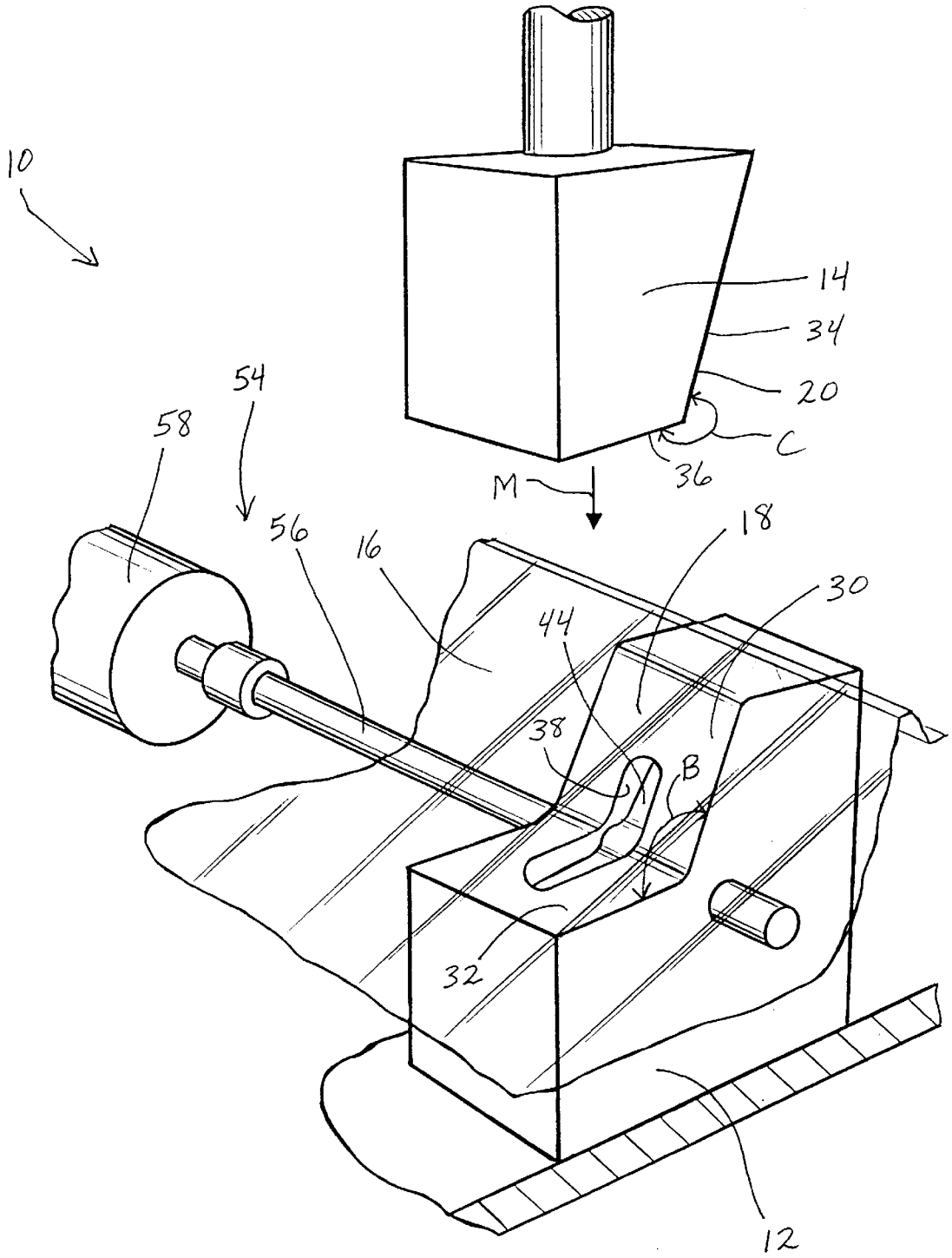
FIG. 1 is a perspective view of a rotary cutting mechanism in accordance with the invention.
Figure 2:
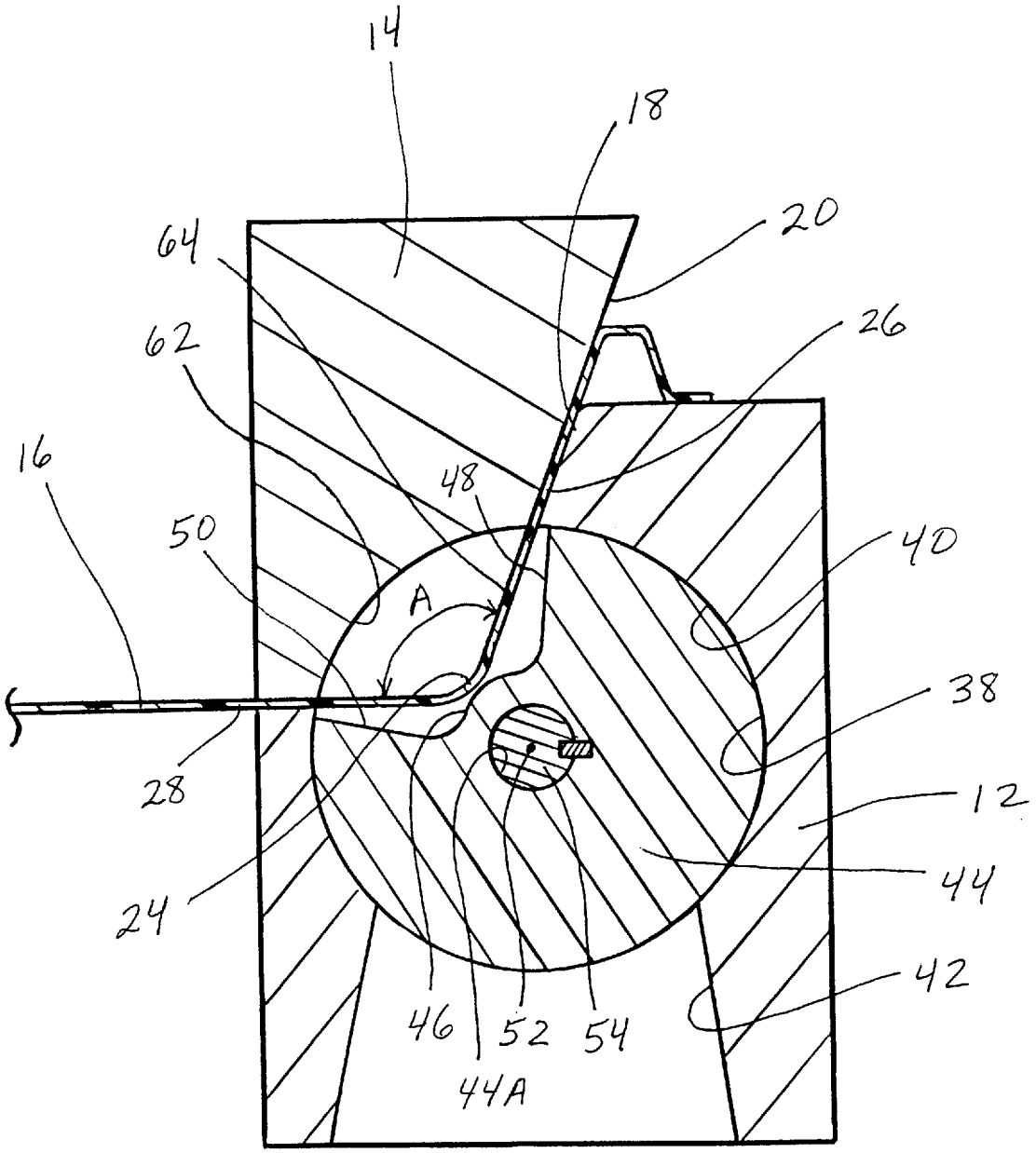
FIG. 2 is a front cross-sectional view of the rotary cutting mechanism of FIG. 1, showing a fixture and a holder of the cutting mechanism holding a nonperpendicular edge of a container therebetween.
Figure 3:
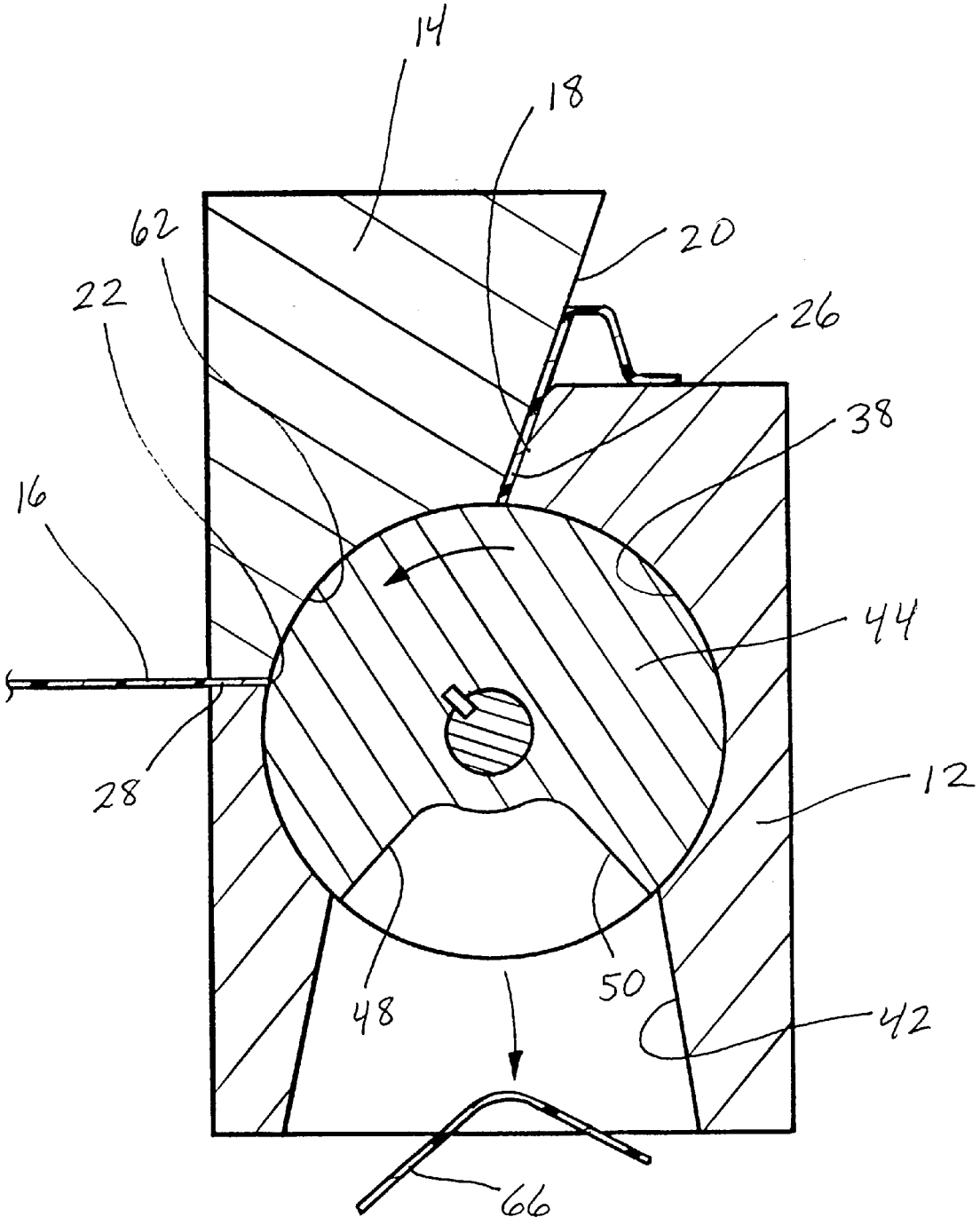
FIG. 3 is a view as in FIG. 2, showing a blade of the cutting mechanism rotated to cut an opening in the edge of the container.

Referring now to the drawings, there is illustrated in FIGS. 1-3 a preferred embodiment of a rotary cutting mechanism, indicated generally at 10, in accordance with the invention. The rotary cutting mechanism 10 includes a fixture and a holding mechanism 14 for holding an article 16 to be cut. The holding mechanism can be any device, structure or material suitable for holding the article for cutting, including devices/structures that are part of the fixture and hold the article on the fixture, such as clamps. Preferably, the holding mechanism is a device that is separate from the fixture, and that cooperates with the fixture to hold the article therebetween. In the illustrated embodiment, the holding mechanism is a separate holder 14 that cooperates with the fixture 12 to hold a thermoformed plastic container 16 therebetween.

The fixture 12 and the holder 14 can be constructed in any manner suitable for holding the container 16 for cutting. In the illustrated embodiment, the fixture 12 and the holder 14 are formed generally as blocks. The fixture 12 and the holder 14 can be formed from any suitable material, preferably a relatively strong, rigid material, such as metal (e.g., steel or aluminum) or plastic. The fixture 12 and the holder 14 have faces or surfaces that cooperate to hold the container 16 therebetween. In the embodiment shown, the fixture 12 includes a fixture face 18, and the holder 14 includes a holder face 20. The structures of the fixture face 18 and holder face 20 are preferably complementary to each other such that they fit together to hold the container 16 therebetween. The fixture face 18 and the holder face 20 are operative to "pinch" the container 16 about the location where an opening 22 (shown in FIGS. 3 and 4) is cut. The cutting of the opening 22 will be described further below. Alternatively, the structure of the fixture face 18 and/or the holder face 20 can be other than illustrated, if desired.

The rotary cutting mechanism 10 can be adapted to cut an associated opening 22 in any portion of the container 16, including a side, edge or corner of the container.

Figure 4:
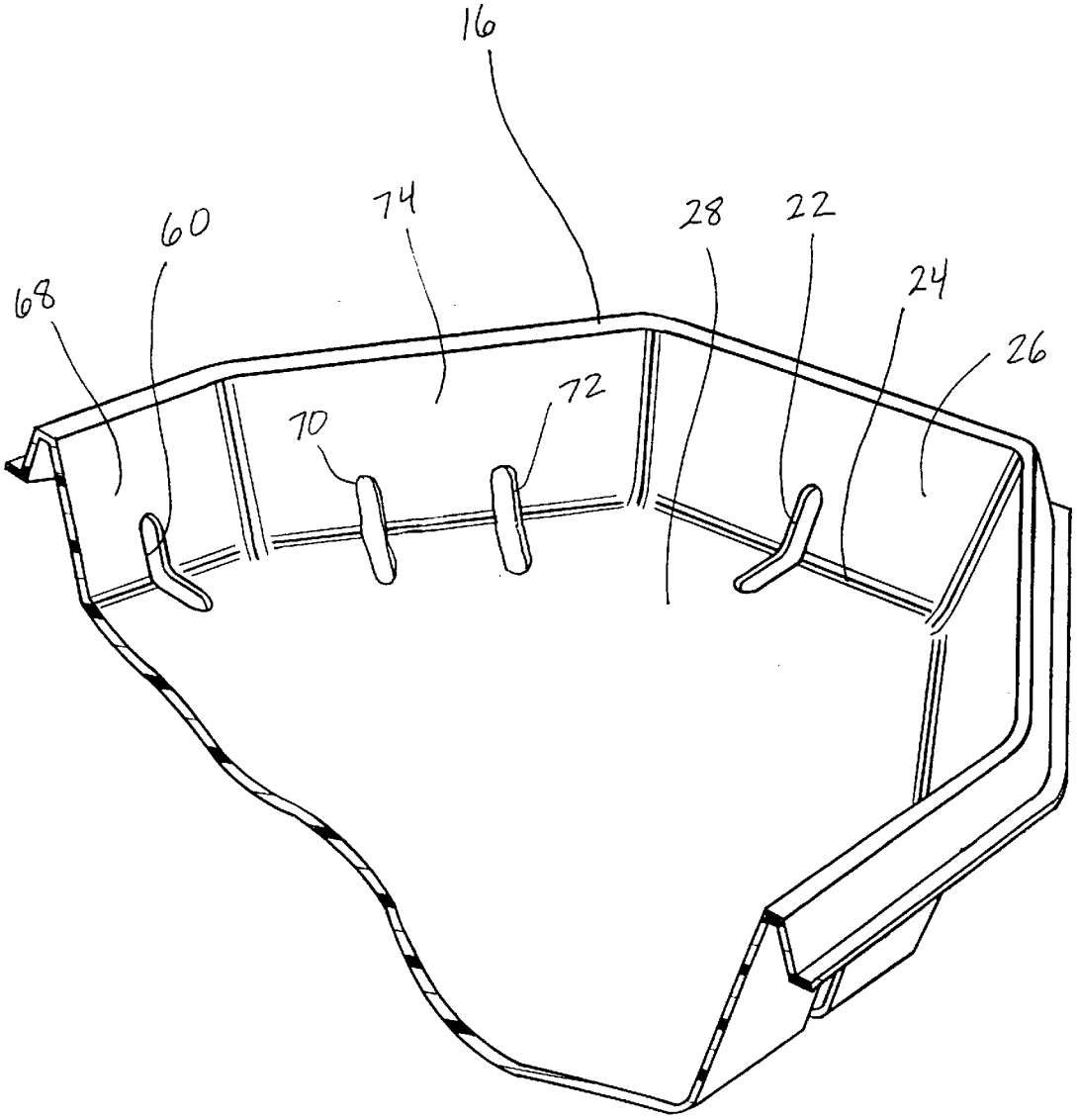
FIG. 4 is a perspective view of the container of FIG. 3, showing multiple openings cut in the edge of the container.

In a preferred embodiment, the rotary cutting mechanism 10 cuts an opening in a nonperpendicular edge or corner of the container 16. As shown in FIGS. 2 and 4, the container 16 includes an edge 24 that defines a nonperpendicular angle A between a sidewall 26 and a top 28 of the container 16 (the container 16 in this embodiment being held upside down for cutting).

The fixture face 18 and the holder face 20 each include portions that are oriented at a nonperpendicular angle relative to each other, to enable the fixture face 18 and the holder face 20 to hold the nonperpendicular edge 24 of the container 16 therebetween. As shown in FIG. 1, the fixture face 18 includes a first face portion 30 and a second face portion 32 that is oriented at an angle B relative to the first face portion 30. The fixture 12 is designed so that the angle B of the fixture face 18 is approximately equal to the angle A defined by the edge 24 of the container 16. In embodiment shown, the angles A and B are obtuse angles (greater than 90° and less than 180°). Similarly, the holder face 20 includes a first face portion 34 and a second face portion 36 that is oriented at an angle C relative to the first face portion 34. The holder 14 is designed so that the angle C of the holder face 20 is complementary to the angle A defined by the edge 24 of the container 16 (i.e., the angles C and A add up to 360°).

The fixture 12 and the holder 14 are movable relative to one another to allow the container 16 to be positioned therebetween. In the illustrated embodiment, the fixture 12 is mounted in a fixed position while the holder 14 is movable upward away from the fixture 12 and downward toward the fixture 12, as indicated by the arrow M. The holder 14 can be moved upward and downward by any suitable means. Alternatively, the fixture 12 could be movable while the holder 14 is fixed, or both the fixture 12 and the holder 14 could be movable.

Figure 5:
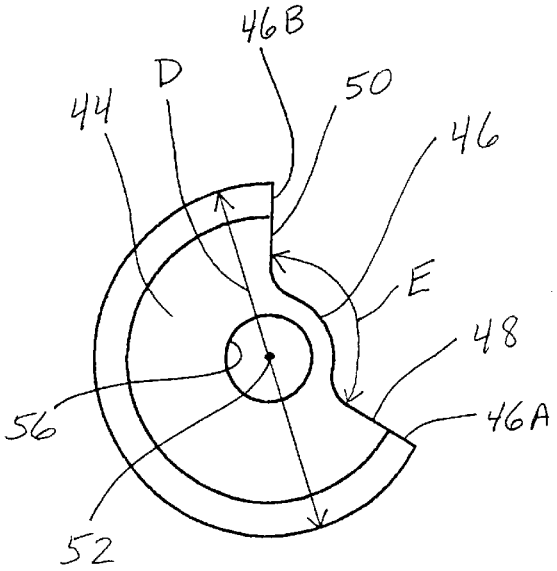
FIG. 5 is a front elevational view of a blade of a rotary cutting mechanism in accordance with the invention.
Figure 6:
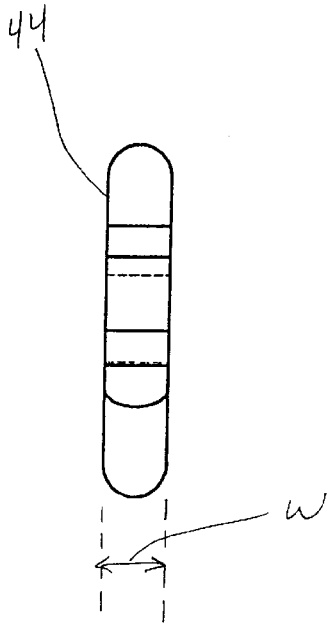
FIG. 6 is a side elevational view of the blade of FIG. 5.

As shown in FIGS. 1 and 2, the fixture 12 has a cavity 38 formed therein that intersects the fixture face 18. The fixture cavity 38 includes an upper cavity chamber 40 and a lower cavity chamber 42. A cutting blade 44 is rotatably mounted in the upper chamber 40. The blade 44 can be any size and shape suitable for cutting the desired opening 22 in the container 16. As shown in FIGS. 2, 5 and 6, a preferred blade 44 is generally in the shape of a disc having an arcuate cutout portion 46. The cutout portion 46 defines a cutting edge. In the illustrated embodiment, the cutout portion 46 defines a first cutting edge 48 along a first end 46A of the cutout portion 46, and a second cutting edge 50 along a second end 46B of the cutout portion 46. As shown in FIGS. 5–6, the blade 44 defines a cutout portion angle E between edges 48 and 50, a blade diameter D, and a blade width W. Depending upon a selected angle E, blade diameter D, and/or blade width W, the size and/or shape of the opening can be varied.

The blade 44 is rotatable about an axis 52. The location of the axis 52 can also be changed to produce a different opening 22. The rotary cutting mechanism 10 includes an actuator 54 to rotate the blade 44. Any suitable type of actuator 54 can be used to rotate the blade 44. In the illustrated embodiment, the actuator 54 includes a rotatably driven pin 56 that extends through a central aperture 44A of the blade 44 and is connected thereto. The pin 56 can be rotatably driven by any suitable drive means, such as a cylinder 58. The blade 44 is rotatable between a first position, in which the cutting edges 48 and 50 are not operative to cut the container 16, and a second position, in which one of the cutting edges 48 or 50 is operative to cut an opening 22 in the container 16. As shown in FIG. 2, in the first position, the entire blade 44 is contained inside the fixture cavity 38. As shown in FIG. 3, the blade 44 is rotatable to a second position in which the first cutting edge 48 extends from the fixture cavity 38 to cut the opening 22 in the container 16. In the illustrated embodiment, the blade 44 can be rotatably driven in two directions. When the blade 44 is rotated in a first direction (counterclockwise in the embodiment shown), the first cutting edge 48 of the blade 44 cuts the first opening 22 in the container 16. When the blade 44 is rotated in a second direction (not shown in FIG. 3), the second cutting edge 50 of the blade 44 cuts a second opening 60 in the container 16 (a second opening 60 is shown in FIG. 4).

In the illustrated embodiment, the holder 14 has a cavity 62 formed therein that intersects the holder face 20. When the holder 14 is moved together against the fixture 12 to hold the container 16 therebetween, the holder cavity 62 is positioned opposite the fixture cavity 38, with the portion 64 of the container 16 to be cut positioned therebetween (as shown in FIG. 2).

In operation, the container 16 is positioned between the fixture 12 and the holder 14, and the fixture 12 and holder 14 are moved together to hold the container 16 therebetween. As shown in FIG. 3, the blade 44 is actuated to rotate in the counterclockwise direction. The first cutting edge 48 extends from the fixture cavity 38, through the sidewall 26 of the container 16, and into the holder cavity 62. The blade 44 continues to rotate until it cuts through the top 28 of the container 16, and extends back into the fixture cavity 38, to cut the first opening 22 in the container 16. As shown in FIG. 4, the first opening 22 is slot-shaped and extends between the sidewall 26 and the top 28 of the container 16.

The fixture 12 includes an ejection mechanism to remove the chip 66 cut from the container 16 to form the first opening 22. The ejection mechanism can be any suitable means for removing the chip 66, such as a mechanical or pneumatic means. In the illustrated embodiment, the chip 66 falls into the lower chamber 42 of the fixture 12 and is removed by a vacuum source (not shown) connected to the lower chamber 42.

After the first opening 22 has been cut, the container 16 can be repositioned to cut the second opening 60 in another sidewall 68 of the container 16, or another container (not shown) can be moved into position for cutting. The blade 44 can be rotated clockwise (not shown) to cut the second opening 60 with the second cutting edge 50 of the blade 44. If desired, a second rotary cutting mechanism (not shown) can be stacked next to or spaced from the illustrated rotary cutting mechanism 10, and the two cutting mechanisms can be actuated together by the pin 54 or a pair of pins 54 to cut a pair of openings 70 and 72 in one or more sidewalls 74 of the container 16. The pin 54 could also actuate two cutting mechanisms to cut one or more openings (not shown) in different sidewalls and/or in different containers. Any number of cuffing mechanisms 10 can be utilized for cutting multiple openings in the same or different containers.

Figure 7:
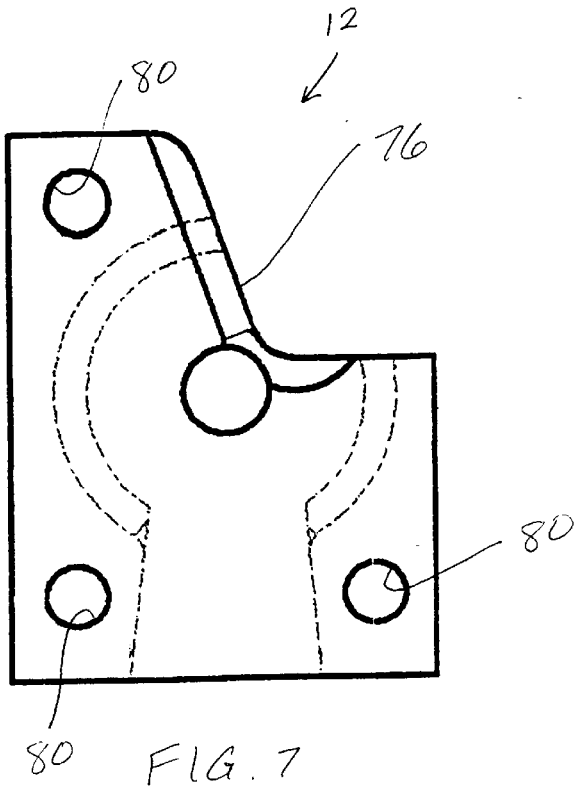
FIG. 7 is a front elevational view of a first part of a two-part fixture of a rotary cutting mechanism in accordance with the invention.
Figure 8:
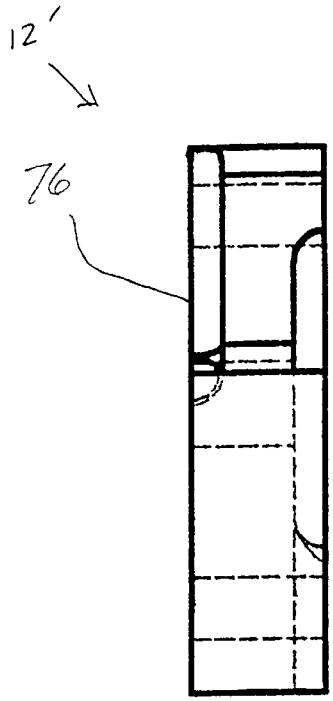
FIG. 8 is a side elevational view of the fixture part of FIG. 7.
Figure 9:
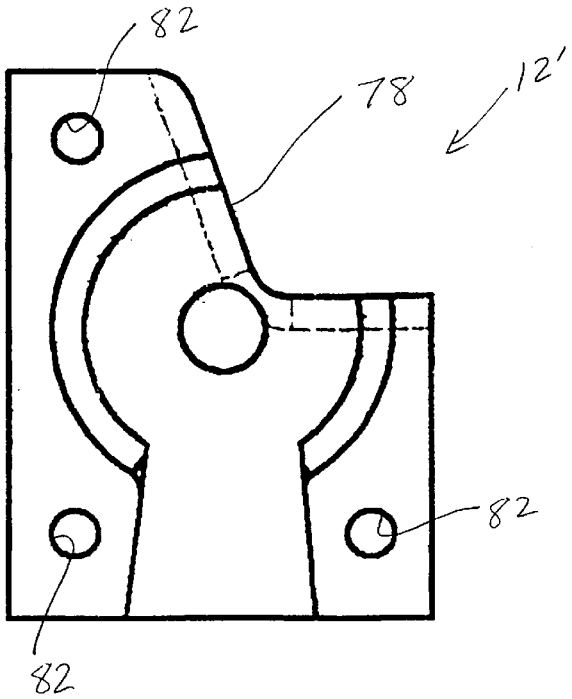
FIG. 9 is a front elevational view of a second part of the two-part fixture.
Figure 10:
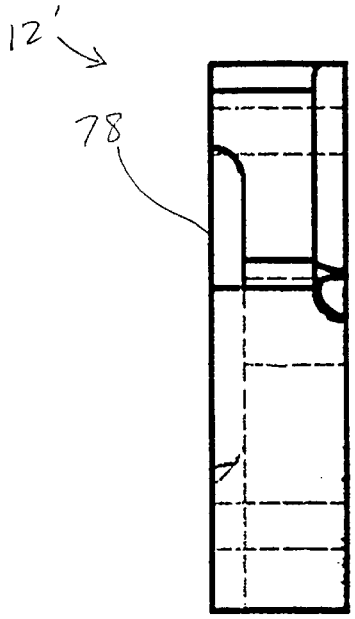
FIG. 10 is a side elevational view of the fixture part of FIG. 9.
Figure 11:
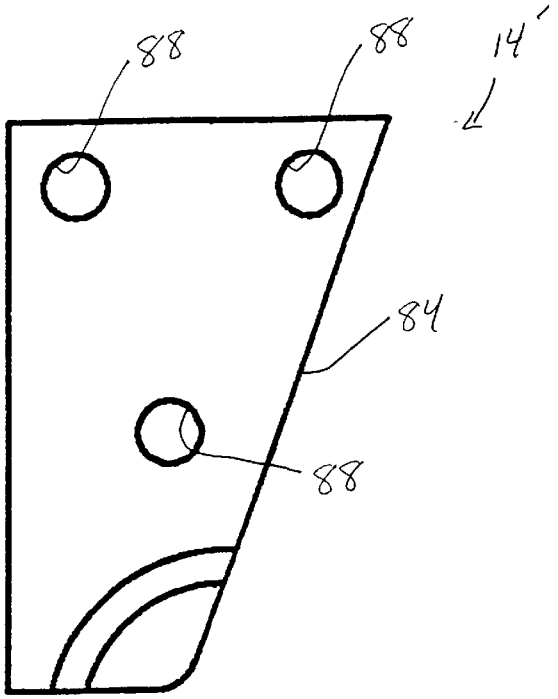
FIG. 11 is a front elevational view of a first part of a two-part holder of a rotary cutting mechanism in accordance with the invention.
Figure 12:
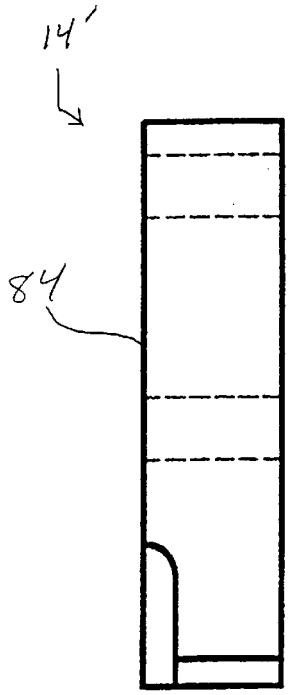
FIG. 12 is a side elevational view of the holder part of FIG. 11.
Figure 13:
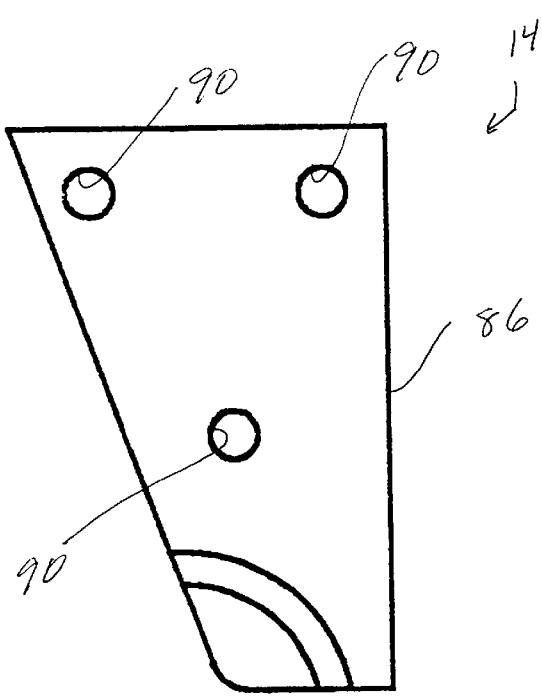
FIG. 13 is a front elevational view of a second part of the two-part holder.
Figure 14:
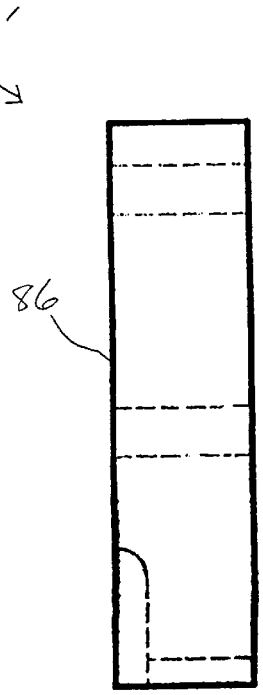
FIG. 14 is a side elevational view of the holder part of FIG. 13.

FIGS. 7–14 illustrate an alternate embodiment wherein each of the fixture 12' and holder 14' is comprised of two parts which are secured together by fasteners. FIGS. 7 and 8 illustrate a first part 76 of a fixture 12', and FIGS. 9 and 10 illustrate a second part 78 of the fixture 12'. The two fixture parts 76 and 78 can be secured together by fasteners (not shown) extending through respective apertures 80 and 82 in the parts 76 and 78. FIGS. 11 and 12 illustrate a first part 84 of a holder 14', and FIGS. 13 and 14 illustrate a second part 86 of the holder 14'. The two holder parts 84 and 86 can be secured together by fasteners (not shown) extending through respective apertures 88 and 90 in the parts 84 and 86. Alternatively, the construction of the fixture 12 and/or the holder 14 can be other than illustrated.

The principle and mode of operation of this invention have been described in its preferred embodiments. However, it should be noted that this invention may be practiced otherwise than as specifically illustrated and described without departing from its scope.

What is claimed is:

1. A rotary cutting mechanism for cutting an opening in an article, comprising:

a holder including a body having a surface, a fixture including a body having a surface, the holder surface and the fixture surface cooperating to hold the article therebetween, and further including a cavity formed in the fixture body; and a blade rotatable mounted in the fixture cavity the blade having a cutting edge, wherein the blade rotates between a first position in which the cutting edge is not operative to cut the opening in the article, and a second position in which the cutting edge is operative to cut the opening in the article;

wherein the holder surface is a holder face and the fixture surface is a fixture face wherein the holder face and the fixture face fit together to hold the article therebetween; and wherein the holder face and the fixture face each include portions that are oriented at a nonperpendicular angle relative to each other to hold a nonperpendicular edge or corner of the article therebetween.

2. The rotary cutting mechanism defined in claim 1 wherein the fixture face includes a first fixture portion and a second fixture portion that is oriented at an angle greater than 90° and less than 180° relative to the first fixture portion.

3. The rotary cutting mechanism defined in claim 1 wherein the holder face and the fixture face fit together to pinch the article about the location of the opening.

4. The rotary cutting mechanism defined in claim 1 wherein the fixture cavity intersects the fixture face.

5. The rotary cutting mechanism defined in claim 4 wherein the blade rotates between a first position in which the entire blade is contained inside the fixture cavity, and a second position in which the cutting edge of the blade extends from the fixture cavity through the article to cut the opening in the article.

6. The rotary cutting mechanism defined in claim 5 wherein the holder surface is a holder face, wherein the holder includes a cavity formed in the holder body which intersects the holder face, and wherein the blade in the second position extends through the article and into the holder cavity.

7. The rotary cutting mechanism defined in claim 1 wherein the blade is disc-shaped and includes a cutout portion that defines the cutting edge.

8. The rotary cutting mechanism defined in claim 7 wherein the cutout portion of the blade defines a first cutting edge which is operative to cut a first opening in the article when the blade rotates in a first direction, and a second cutting edge which is operative to cut a second opening in the article when the blade rotates in a second direction.

9. The rotary cutting mechanism defined in claim 7 wherein the blade is operative to cut a chip from the article to cut the opening, and the fixture includes an ejection mechanism to remove the chip.

10. The rotary cutting mechanism defined in claim 1 further including an actuator that rotates the blade from the first position to the second position.

11. The rotary cutting mechanism defined in claim 1 wherein the article comprises a thermoformed plastic container.

12. A rotary cutting mechanism for cutting an opening in a thermoformed plastic container, comprising:

a holder including a body having a face, a fixture including a body having a face, the holder face and the fixture face fitting together to hold the container therebetween, wherein the holder face and the fixture face each include portions that are oriented at an angle relative to each other to hold a nonperpendicular edge or corner of the container therebetween, and further including a cavity formed in the fixture body, and a blade rotatably mounted in the fixture cavity, the blade having a cutting edge, wherein the blade rotates between a first position in which the cutting edge is not operative to cut the container, and a second position in which the cutting edge is operative to cut the opening in the container.

13. The rotary cutting mechanism defined in claim 12 wherein the blade is disc-shaped and includes a cutout portion that defines the cutting edge.

14. A rotary cutting mechanism for cutting an opening in an article, comprising:

a fixture including a body and a cavity formed in the fixture body, and further including a holding mechanism that holds the article on the fixture; and a blade rotatable mounted in the fixture cavity, the blade having a cutting edge wherein the blade rotates between a first position in which the cutting edge is not operative to cut the article. and a second position in which the cutting edge is operative to cut the opening in the article;

wherein the holding mechanism holds the article on a face of the fixture, wherein the fixture cavity intersects the fixture face, and wherein the blade rotates between a first position in which the entire blade is contained inside the fixture cavity, and a second position in which the cutting edge of the blade extends from the fixture cavity through the article to cut the opening in the article.

15. The rotary cutting mechanism defined in claim 14 wherein the blade is disc-shaped and includes a cutout portion that defines the cutting edge.

16. The rotary cutting mechanism defined in claim 14 wherein the article comprises a thermoformed plastic container.

* * * * *